US005141394A

United States Patent [19]

Donlan

[11] Patent Number: 5,141,394

[45] Date of Patent: Aug. 25, 1992

[54] APPARATUS AND METHOD FOR SUPPORTING A VANE SEGMENT IN A GAS TURBINE

[75] Inventor: John P. Donlan, Ovideo, Fla.

[73] Assignee: Westinghouse Electric Corp., Pittsburgh, Pa.

[21] Appl. No.: 597,974

[22] Filed: Oct. 10, 1990

[51] Int. Cl.[5] ..... F01D 1/02

[52] U.S. Cl. ..... 415/190; 415/201; 415/209.4

[58] Field of Search ..... 415/209.2, 209.3, 209.4, 415/210.1, 190

[56] References Cited

U.S. PATENT DOCUMENTS

| | | | |
|---|---|---|---|
| 3,070,352 | 12/1962 | Welsh | 415/209.4 |
| 3,104,091 | 9/1963 | Vivian | 415/209.4 |
| 3,411,794 | 11/1968 | Allen | 415/174.4 |
| 3,644,057 | 2/1972 | Steinburger | 415/209.2 |
| 3,727,660 | 4/1973 | Burge | 415/209.2 |
| 3,843,279 | 10/1974 | Crossley | 415/191 |
| 4,274,805 | 6/1981 | Holmes | 415/138 |
| 4,286,921 | 9/1981 | Donlan | 415/190 |
| 4,890,978 | 1/1990 | McLaurin et al. | 415/209.4 |

*Primary Examiner*—Edward K. Look
*Assistant Examiner*—Therese M. Newholm

[57] ABSTRACT

An apparatus and method are provided for aligning and supporting vane segments in the turbine section of a gas turbine. According to the invention, the vane segments are supported and aligned to an inner cylinder. The apparatus features a plate, having threaded holes, which is fixed to the inner cylinder. A threaded plug, having an eccentric hole, is threaded into each threaded hole in the plate. A pin, having flats and a chamfer formed at one end, is inserted into the eccentric hole in the plug. At assembly, the plug is rotated in the threaded hole and the pin is rotated in the eccentric hole until the pin enters a slot in the inner shroud of the vane segment. The pin supports and aligns the vane segment by bearing against a side of the slot. The plug is locked in place by a nut threaded onto the plug.

22 Claims, 4 Drawing Sheets

APPARATUS AND METHOD FOR SUPPORTING A VANE SEGMENT IN A GAS TURBINE

BACKGROUND OF THE INVENTION

1. Field of the Invention

The present invention relates to gas turbines. More specifically, the present invention relates to an apparatus and method for supporting the vane segments in the turbine section of a gas turbine.

A portion of the annular gas flow path in the turbine section of a gas turbine is formed by vane segments circumferentially arrayed around the rotor. Each vane segment is comprised of an inner and an outer shroud, which together form the boundaries of the gas flow path, and one or more vanes. In order to maintain aerodynamic efficiency, it is important that the inner and outer shrouds of adjacent vane segments be properly aligned relative to each other so that a smooth surface is provided over which the hot gas may flow. Moreover, even though the shrouds may be properly aligned at assembly, aerodynamic forces imposed on the vane segments may result in misalignment of the shrouds under operating conditions. Hence, it is important that the vane segments be adequately supported so as to resist the aerodynamic forces imposed on it.

2. Description of the Prior Art

According to one approach used in the prior art to align and support the vane segments, each vane segment is affixed at its outer shroud to a cylinder, referred to as a blade ring, which encloses the vane segments. In addition, each vane segment is aligned and supported at its inner shroud by an inner cylinder. The inner cylinder support is achieved as follows. A series of torque plates are affixed to the inner cylinder so as to enclose slotted portions of the inner shrouds. The torque plates contain a splined hole for each vane segment. A splined bushing, having an eccentric pin projecting from its face, is partially inserted into the splined hole in the torque plate so that the pin engages the slot formed in the inner shroud. However, the bushing is not inserted so far into the hole that the splines in the bushing engage the splines in the hole. A cover plate is then threaded behind the bushing to stabilize it. With the cover plate in place, a square drive on the face of the bushing opposite the pin is used to rotate the bushing so that the pin forces the vane segment into alignment. After the proper alignment is obtained, the eccentric bushing is locked in place by inserting the bushing further into the hole so that the splines are engaged. The cover plate prevents disengagement of the splines by restraining motion of the bushing in the axial direction. The cover plate is peened to the torque plate to prevent the cover plate from backing out of the hole. This scheme is disclosed in U.S. Pat. No. 4,890,978, assigned to the same assignee as the current invention.

The prior art method of aligning and supporting vane segments discussed above suffers from three drawbacks. First, alignment of the vane segments can only be done on an incremental basis since the number of positions in which the bushing can be installed is limited by the number of splines. Thus, some degree of vane segment misalignment results when, as is usually the case, the desired position of the bushing for alignment purposes does not permit engagement of the splines. Hence, it would be desirable to devise a scheme which allowed infinitely fine adjustment of the vane segment alignment.

Second, since the orientation of the pin when it enters the inner shroud slot in the correctly aligned position cannot be determined in advance, the body of the pin is round to allow engagement with the slot in any orientation. However, the round pin shape results in line contact between the pin and the slot. Line contact is undesirable because vibration of the turbine components causes minute relative motion between the pin and slot resulting in wear along the contact line, eventually the wear results in a loosening of the pin in the slot and a loss of the original alignment.

Third, once the eccentric bushing is partially installed in the hole, the assembler is not able to observe the slot in the inner shroud. Thus, rotation of the eccentric bushing and minute adjustment in the vane segment alignment to allow the pin to enter the slot must be done on a trial and error basis. As a result, assembly of the inner shroud support structure is often a time consuming and tedious procedure.

Accordingly, it would be desirable to provide an apparatus and method for aligning and supporting vane segments which (1) allows infinitely fine adjustment of the vane segment alignment; (2) provides surface contact between the load-bearing surfaces on the alignment device and the inner shroud slot; and (3) aids the assembler in his efforts to insert the pin into the slot without visual guidance.

SUMMARY OF THE INVENTION

It is the object of the current invention to provide a means for aligning and supporting a gas turbine vane segment.

It is a further object of the invention that such aligning and supporting means be capable of infinitely fine adjustment of the alignment of the vane segment.

It is still another object of the invention that the load-bearing surfaces of the alignment and support device not be subject to wear which would tend to upset the alignment.

These and other objects are accomplished in a gas turbine having an annular array of vane segments in its turbine section. Each vane segment is supported and aligned to an inner cylinder by attaching a torque plate, having threaded holes, to the inner cylinder and inserting a threaded plug into the hole in the torque plate. A pin is then inserted into an eccentric hole in the threaded plug and the plug and pin are rotated until the pin can be pushed into a slot in the inner shroud of the vane segment. The plug is then rotated so that a flat surface on the end of the pin is loaded against the side of the slot. A nut locks the threaded plug in place, preventing further rotation, and a cap retains the pin, preventing it from disengaging from the inner shroud slot.

DESCRIPTION OF THE PREFERRED EMBODIMENT

Figure 1:
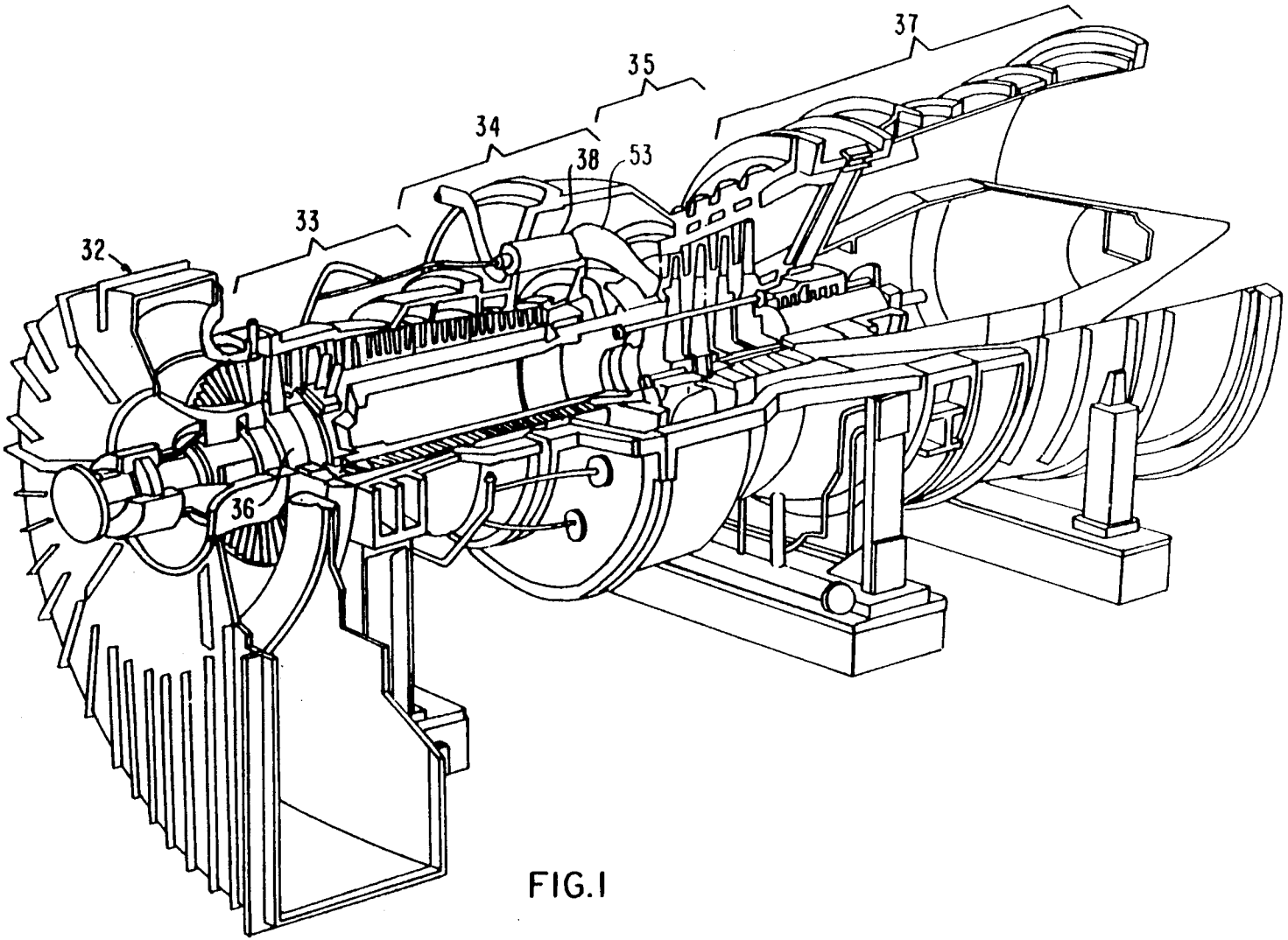
FIG. 1 is an isometric view, partially cut away, of a gas turbine.

There is shown in FIG. 1 a gas turbine. The major components of the gas turbine are the inlet section 32, through which air enters the gas turbine; a compressor section 33, in which the entering air is compressed; a combustion section 34 in which the compressed air from the compressor section is heated by burning fuel in combustors 38; a turbine section 35, in which the hot compressed gas from the combustion section is expanded, thereby producing shaft power; and an exhaust section 37, through which the expanded gas is expelled to atmosphere. A centrally disposed rotor 36 extends through the gas turbine.

Figure 2:
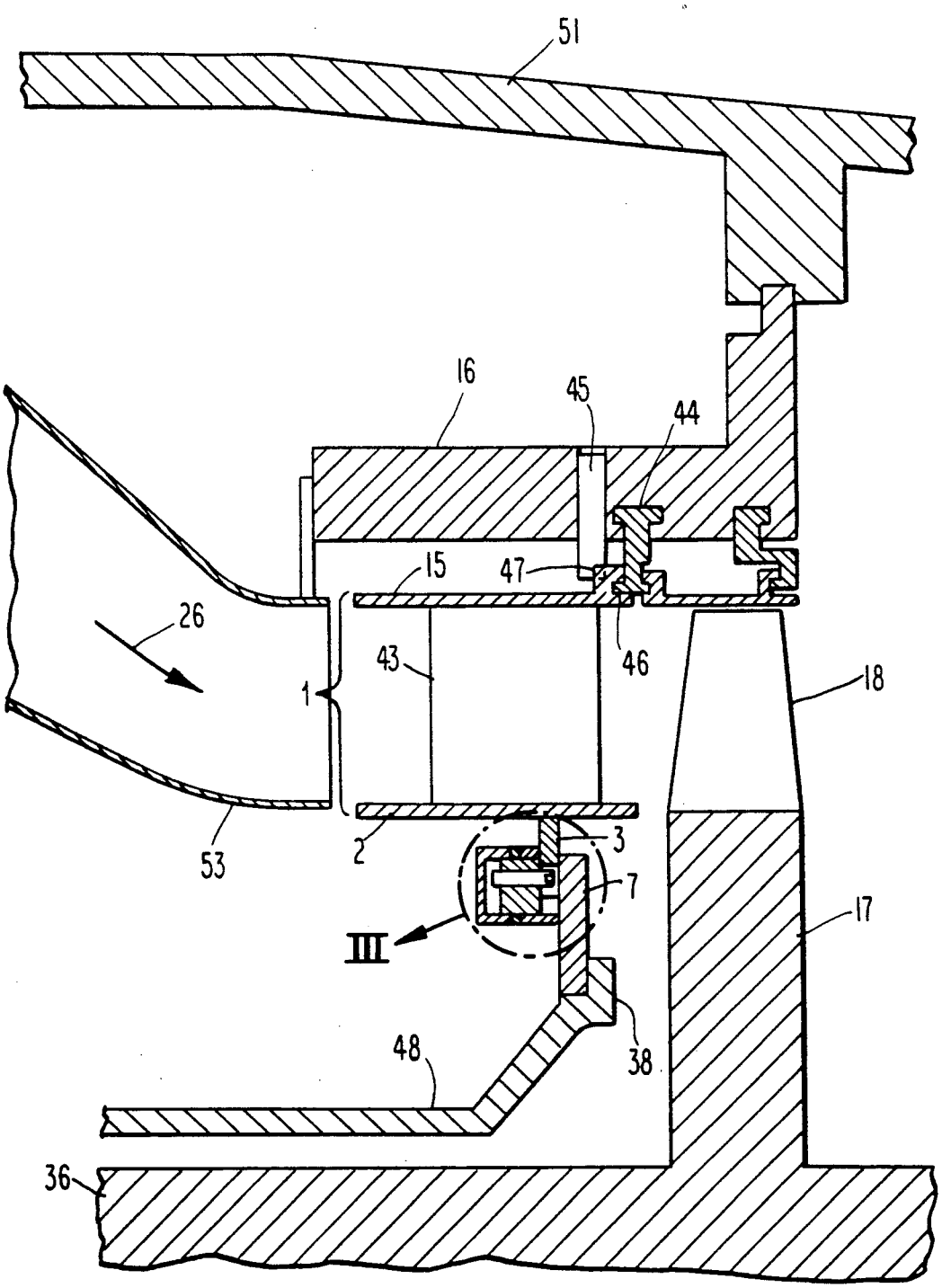
FIG. 2 is a cross-section of a portion of the turbine section of the gas turbine shown in FIG. 1 in the vicinity of the row 1 vane segment.

The turbine section 35 of the gas turbine is comprised of alternating rows of stationary vanes and rotating blades. Each row of vanes is arranged in a circumferential array around the rotor 36. FIG. 2 shows a portion of the turbine section in the vicinity of the row 1 vane assembly. Typically, the vane assembly is comprised of a number of vane segments 1. Each vane segment 1 is comprised of a vane airfoil 43 having an inner shroud 2 formed on its inboard end and an outer shroud 15 formed on its outboard end. Alternatively, each vane segment may be formed by two or more vane air foils having common inner and outer shrouds.

As shown in FIG. 2, the vane segments 1 are encased by a cylinder 16, referred to as a blade ring. Also, the vane segments encircle an inner cylinder structure 48. The inner cylinder structure comprises a ring 7 affixed to a rear flange 38 of the inner cylinder. A row of rotating blades 18, affixed to a disk portion 17 of the rotor 36, is disposed downstream of the stationary vanes. A turbine outer cylinder 51 encloses the turbine section.

During operation, hot compressed gas 26 from the combustion section is directed to the turbine section by duct 53. The hot gas flows over the vanes, imposing aerodynamic loads in the form of bending moments and torque loads. If the vane segments were not fixed to the blade ring 16 or inner cylinder structure 48, the torque load would tend to rotate the vane segments about the center line of the rotor. The direction in which the torque is applied depends on the geometry of the vane segments, which, in turn, is a function of whether the rotor is designed to rotate in a clockwise or counterclockwise direction. The gas turbine described herein is designed for clockwise rotor rotation, when looking with the direction of flow. Thus, the torque load tends to rotate the vane segments in the counterclockwise direction, when looking with the direction of flow.

Figure 4:
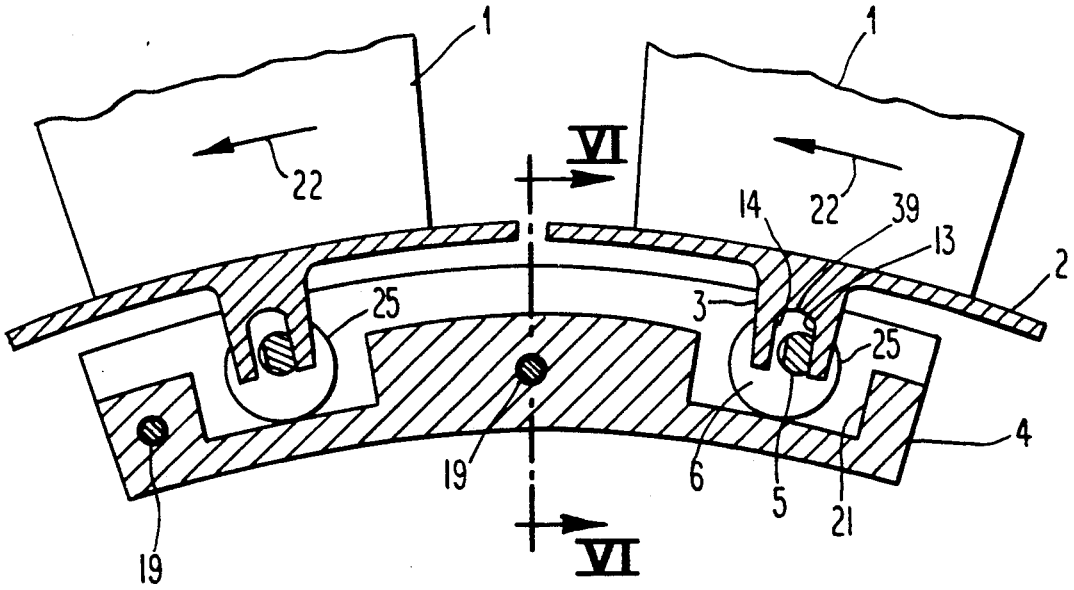
FIG. 4 is a cross-section taken through line IV—IV shown in FIG. 3.

The vane segments are fixed to the blade ring 16 at their outer shroud 15 so that motion is restrained in the radial and circumferential directions. The radial restraint is provided by mating a slot 46 in the outer shroud 15 with a ring 44 affixed to the blade ring 16. The circumferential restraint is provided by a pin 45 which engages a keyway 47 in the outer shroud. The subject of the present invention concerns the support of the vane segments 1 by the inner cylinder structure 48. As shown in FIG. 4, a lug 3 protrudes radially inward from the inner surface of the inner shroud 2. A slot 39 is formed in each lug and serves as the point at which the inner shroud is supported to the inner cylinder structure 48. Radially oriented surfaces 13 and 14 form the sides of the slot 39. As explained further below, surface 13 forms a load-bearing surface for the slot.

Figure 3:
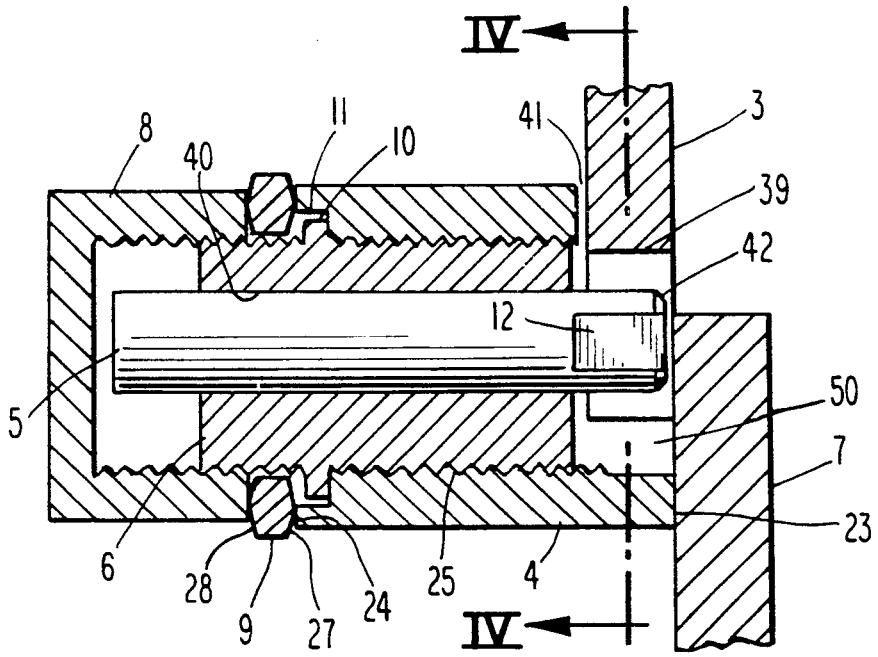
FIG. 3 is a detailed view of the portion of FIG. 2 denoted by the circle marked III, showing the vane segment inner shroud support apparatus.
Figure 6:
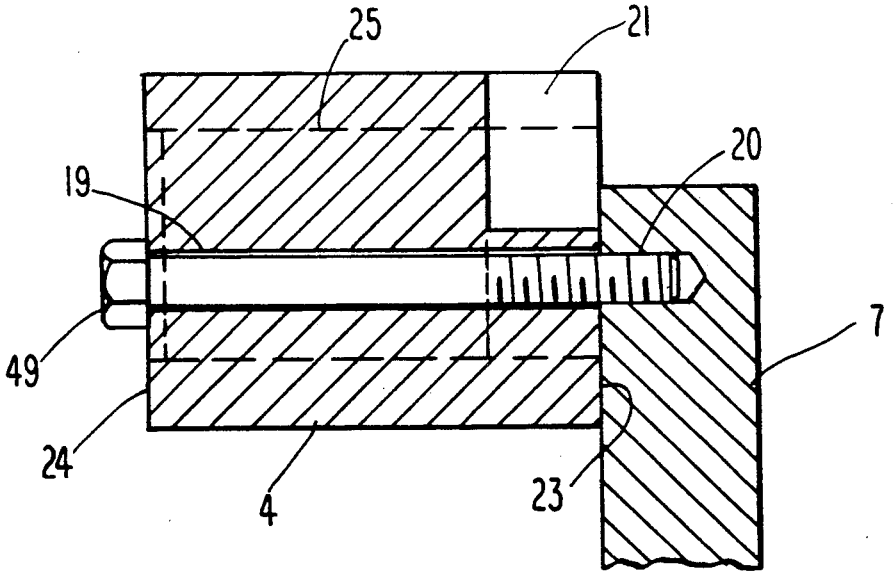
FIG. 6 is a cross-section taken through VI—VI shown in FIG. 4.

During assembly, the vane segments are first attached to the blade ring 16 and are then correctly aligned with respect to each other. A support assembly comprised of torque plates 4 is then affixed to the upstream face of the ring 7. In the preferred embodiment, each torque plate 4 is an arcuate member as shown in FIG. 4. As installed, the torque plate has upstream 24 and downstream 23 axial faces, as shown in FIG. 3. Two holes 25, each having female threads are located in the upstream axial face 24. A recess 21 is formed in the downstream axial face 23. Each torque plate 4 is attached to the ring 7 by bolts 49 that extend through holes 19 in the torque plate and threaded holes 20 in the ring, as shown in FIG. 6. As shown in FIG. 3, after installation on the ring 7, the recess 21 in the torque plate forms a cavity 50 enclosing the lug 3. Thus, the torque plates 4 and the ring 7 provide upstream and downstream axial restraints, respectively, for the vane segments. These axial bending restraints enable the vane segments to resist the moments imposed on them.

As shown in FIG. 3, a cylindrical plug 6 that has male threads formed on its external surface is screwed into hole 25 until shoulder 10, formed on each plug, bottoms in a counterbore 11 formed in the hole 25. Note that the length of the plug 6 downstream of the shoulder 10 and the depth of the recess 21 that forms cavity 50 are such that gap 41 is provided between the torque plate/plug and the lug 3 to allow for differential axial thermal expansion between the blade ring 16 and the inner cylinder support structure 48.

Figure 5:
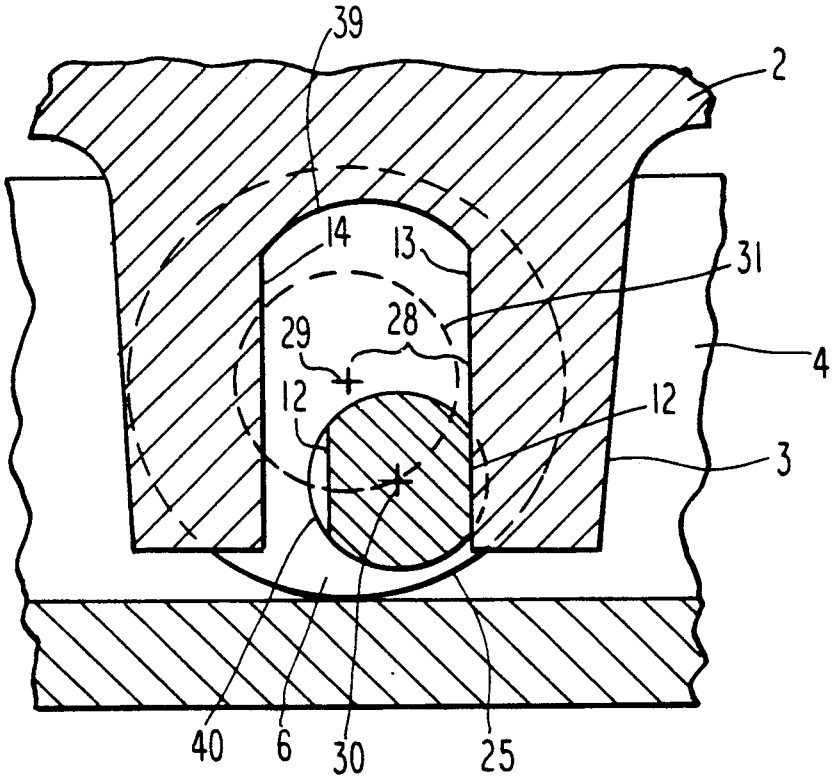
FIG. 5 is an enlarged view of the vane segment inner shroud support apparatus shown in FIG. 4.

After installation of the plug 6, a cylindrical pin 5 is inserted into an axially oriented eccentric hole 40 in the plug so that the pin 5 is also axially oriented. As shown in FIG. 5, the common center line 30 of the hole 40 and the pin 5 is eccentric from the common center line 29 of the hole 25 in the torque plate and the plug 6—that is, centerline 30 is parallel to, but not coincident with, centerline 29. Thus, when the plug 6 is rotated relative to the torque plate by screwing the plug into or out of the hole 25, the center line 30 of the pin describes a circle 31 about the center line 29 of the hole 25 and plug 6. A key is formed on the pin by machining flat surfaces 12, which act as load-bearing surfaces, in the downstream end of the pin 5. As shown in FIG. 5, the distance from the center line 30 of the pin to either flat 12 is less than the distance 28 from the center line 29 of the hole 25 and plug 26 to radially oriented surface 13 of the slot 39, so that rotation of the plug causes flat 12 on the pin to come into contact with surface 13.

When the pin 5 is inserted into the plug 6, it initially bottoms against the upstream face of the lug 3. The plug 6 is then rotated counterclockwise, looking with the direction of flow, thereby screwing it out of the hole 25, until the pin 5 is aligned with the slot 39. In this regard, a chamfer 42 is formed in downstream end of the pin 5. By applying a downstream axial force on the pin while rotating the plug, the chamfer acts as a finder, allowing the installer to feel when the pin is aligned with the slot by sensing that the chamfer has dropped into the slot. Thus, the time required to assemble the inner shroud support is greatly reduced. Note that the width of the slot 39 is less than the diameter of the body of the pin but more than the width of the pin across the flats 12, so that the pin cannot be inserted into the slot unless the flats are aligned parallel with the radially oriented faces 13 and 14 of the slot. Thus, once the pin 5 and slot 39 are aligned, the pin is rotated in hole 40 until it can be inserted into the slot, indicating that the flats 12 are aligned with the slot faces 13 and 14.

As shown in FIG. 4, which is looking with flow, the torque load 22, resulting from the gas 26 flowing over the vane, is applied to the vane segments in a counterclockwise direction. To properly align the vane segments and assure the gas forces do not result in misalignment during operation, the vane segments must be secured against movement in the counterclockwise direction. Thus, after the pin is inserted into the slot, the plug 6 is rotated to insure that flat 12 bears against slot face 13 (rather than face 14), since face 13 faces the direction of torque load.

It is important to note that since the loading on the vane is transmitted through surface contact between the slot face 13 and the pin flat 12, rather than the merely line contact achieved by the prior art, the potential for wear of the pin and subsequent loss of alignment is greatly reduced.

Once the plug 6 has been rotated into its proper position, it is locked in place by nut 9, which is threaded onto the plug until the downstream face 27 of the nut is tightened against the upstream axial face 24 of the torque plate 4. Note that unlike the splined scheme used in the prior art, use of the threaded plug 6 and rotatable pin 5 of the present invention allows the plug to be rotated and locked into any position, thus allowing infinitely fine adjustment of the vane segment alignment.

Lastly, threaded cap 8 is screwed onto the plug and tightened against the upstream face 28 of the nut 9. The cap prevents disengagement of the pin 5 by restraining its motion in the axial direction.

Although the above description has been directed to a preferred embodiment of the invention, it is understood that other modifications and variations known to those skilled in the art may be made without departing from the spirit and scope of the invention as set forth in the appended claims.

I claim:

1. A gas turbine comprising:

(a) a turbine section, said turbine section having an inner structure and having a circumferential array of stationary vane segments encircling said inner structure;

(b) a support assembly attached to said inner structure, and a threaded hole having a center line formed in said support assembly corresponding to each respective one of said vane segments;

(c) a threaded plug corresponding to each respective one of said vane segments, each of said threaded plugs being threaded into one of said threaded holes in said support assembly, whereby said threaded plugs are capable of assuming any rotational position within said threaded holes, and an eccentric hole formed in each of said threaded plugs; and (d) a pin corresponding to each respective one of said vane segments, each of said pins having means for engaging one of said vane segments, each of said pins being disposed in one of said eccentric holes, whereby rotation of each of said threaded plugs within said threaded holes causes each of said pins to describe a circle around said center line of each of said threaded holes, said pins being capable of being disposed at any circumferential location around said circle.

2. The gas turbine according to claim 1 further comprising means for preventing rotation of each of said threaded plugs relative to its respective threaded hole in said support assembly at any rotational position within said threaded hole.

3. The gas turbine according to claim 2 wherein each of said eccentric holes and each of said pins disposed therein are axially oriented, and further comprising means for restraining motion of each of said pins in the axial direction.

4. The gas turbine according to claim 3 wherein said means for preventing rotation of said threaded plugs comprises a nut for each of said threaded plugs, each of said nuts threaded onto its respective threaded plug.

5. The gas turbine according to claim 1 wherein said support assembly is comprised of a plurality of arcuate members, each of said arcuate members having first and second axially oriented faces, each of said first axially oriented faces being in contact with said inner structure, a relief being formed in each of said first axially oriented faces, said reliefs forming a plurality of cavities between said inner structure and said first axially oriented faces.

6. The gas turbine according to claim 5 wherein:

(a) each of said vane segments has an inboard end and an outboard end, an inner shroud formed on each of said inboard ends, a radially oriented lug formed on each of said inner shrouds, a slot formed in each of said lugs, each of said lugs disposed in one of said cavities formed between said arcuate members and said inner cylinder structure; and (b) each of said pins has first and second ends, a key formed on each of said first ends, each of said keys mating with said slots in said inner shrouds.

7. The gas turbine according to claim 6 wherein:

(a) each of said pins is a cylindrical member; and (b) each of said keys comprises a flat formed on the surface of said pin, whereby said mating of said key with said slot results in surface contact.

8. The gas turbine according to claim 5 further comprising a nut for each of said threaded plugs, each of said nuts being threaded onto its respective threaded plug so that said nut bears against said second axially oriented face.

9. The gas turbine according to claim 8 further comprising a threaded cap for each of said threaded plugs, each of said threaded caps being threaded onto its respective threaded plug so that said threaded cap bears against said nut.

10. In a gas turbine having a centrally disposed rotor and a stationary member, said stationary member having first and second ends, and a torque load applied to said stationary member, support means for supporting said stationary member at said first end, said support means comprising:

(a) a cylinder encircling said rotor;

(b) a first load bearing surface formed on said first end of said stationary member;

(c) a plate affixed to said cylinder, said plate having an axially oriented face, and a first hole having a center line formed in said axially oriented face;

(d) a cylindrical plug disposed in said first hole, means for rotating said cylindrical plug into any rotational position within said first hole, and a second hole formed in said cylindrical plug, the centerline of said second hole being parallel to but not coincident with the axis of said cylindrical plug; and (e) a rotatable pin disposed in said second hole, said pin having a second load bearing surface formed thereon, said cylindrical plug being rotatably mounted in said first hole and said pin being rotatably mounted in said second hole so that said second load bearing surface can be placed in contact with said first load bearing surface regardless of the circumferential orientation of said cylindrical plug in said first hole.

11. The gas turbine according to claim 10 wherein said means for rotating said cylindrical plug into any rotational position comprises:

(a) female threads formed in said first hole; and (b) male threads formed on said cylindrical plug.

12. The gas turbine according to claim 11 further comprising means for fixing said rotational position of said cylindrical plug in said first hole in any rotational position.

13. The gas turbine according to claim 12 wherein said means for rotational position fixing comprises a nut threaded onto said male threads on said cylindrical plug.

14. The gas turbine according to claim 13 wherein said pin has first and second ends, said second load bearing surface comprising a flat surface formed in said first end.

15. The gas turbine according to claim 14 wherein said pin has a chamfer formed in said first end.

16. The gas turbine according to claim 13 wherein said pin has a longitudinal center line, the distance from said longitudinal center line of said pin to said second load bearing surface being greater than the distance from the centerline of said first hole to said first load bearing surface.

17. The gas turbine according to claim 16 wherein said first load bearing surface is a radially oriented surface facing the direction in which said torque load is applied to said stationary member.

18. The gas turbine according to claim 17 wherein:

(a) said plate has an axially oriented surface, said first hole in said plate being formed in said axially oriented surface; and (b) said nut has an axially oriented face, said axially oriented face of said nut bearing against an axially oriented surface of said plate.

19. In a gas turbine having a blade ring and an inner cylinder, a plurality of vane segments, each of said vane segments having inboard and outboard ends, a slot being formed in said inboard end of each of said vane segments, a torque plate having a recess and a threaded hole formed therein, a threaded plug having an eccentric hole formed therein, a pin, and a nut, a method of installing said vane segments in said gas turbine comprising the steps of:

(a) fixing said outboard ends of said vane segments to said outer cylinder;

(b) attaching said torque plate to said inner cylinder so that said recess covers said slot;

(c) threading said plug into said threaded hole;

(d) inserting said pin into said eccentric hole and rotating said threaded plug into a rotational orientation within said threaded hole until said pin is aligned with said slot, the rotation of said threaded plug within said threaded hole being continuous and not limited to predetermined increments;

(e) engaging said pin in said slot; and (f) threading said nut onto said threaded plug and tightening said nut against said torque plate.

20. The method according to claim 19 wherein said pin has first and second ends, a chamfer formed on said first end, and the step of rotating said threaded plug until said pin is aligned with said slot comprises the further step of applying force to said second end of said pin while said threaded plug is being rotated and feeling when said chamfer engages said slot.

21. The method according to claim 20 wherein said pin has a flat formed at said first end, said slot has a side, and the step of engaging said pin in said slot comprises the further step of rotating said threaded plug so that said flat bears against the side of said slot.

22. In a gas turbine having a plurality of vane segments and an inner cylinder, each said vane segment having an inner shroud, a lug emnating radially inward from each said inner shroud, and a slot formed in each said lug, an apparatus for supporting and aligning said vane segments to said inner cylinder comprising:

a) a plurality of plates affixed to said inner cylinder and having formed therein a threaded hole having a center line corresponding to each of said vane segments;

b) a threaded plug disposed in each of said threaded holes, whereby said threaded plugs are capable of assuming any rotational position within said threaded holes, each of said threaded plugs having an eccentric hole formed therein; and c) a pin disposed in each of said eccentric holes, whereby rotation of said threaded plug within said threaded hole causes said pin to describe a circle around said center line of said threaded hole, said pin being capable of being disposed at any circumferential location around said circle.

* * * * *